US009714402B2

(12) United States Patent
Kropf et al.

(10) Patent No.: US 9,714,402 B2
(45) Date of Patent: Jul. 25, 2017

(54) WASHING AND CLEANING AGENT

(71) Applicant: Henkel AG & Co. KGaA, Duesseldorf (DE)

(72) Inventors: Christian Kropf, Hilden (DE); Nicole Bode, Duesseldorf (DE); Thomas Gerke, Duesseldorf (DE); Christian Umbreit, Neuss (DE); Sylvia Aust, Hilden (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/175,691

(22) Filed: Jun. 7, 2016

(65) Prior Publication Data

US 2016/0289603 A1 Oct. 6, 2016

Related U.S. Application Data

(63) Continuation of application No. PCT/EP2014/077130, filed on Dec. 10, 2014.

(30) Foreign Application Priority Data

Dec. 16, 2013 (DE) ..... 10 2013 226 003

(51) Int. Cl.
*C11D 3/20* (2006.01)

(52) U.S. Cl.
CPC ..... *C11D 3/2096* (2013.01)

(58) Field of Classification Search
CPC ..... C11D 3/20; C11D 3/2096
See application file for complete search history.

(56) References Cited

U.S. PATENT DOCUMENTS

2012/0157370 A1 6/2012 Kropf et al.
2012/0260433 A1 10/2012 Tetard et al.

FOREIGN PATENT DOCUMENTS

DE 4231465 A1 3/1994
WO 2007/042140 A2 4/2007

OTHER PUBLICATIONS

Fox et al, "Bis(5-hydroxy-2-hydroxymethyl-pyran-4-one-6-yl)methane, A novel ligand for the intracellular mobilisation of ferritin bound iron", Bioorganic & Medicinal Chemistry Letters, vol. 8, pp. 443-446, 1998.*

PCT International Search Report (PCT/EP2014/077130) dated Dec. 3, 2015.

Fox et al., "Bis(5-hydroxy-2-hydroxymethyl-pyran-4-one-6-yl)methane: A novel ligand for the intracellular mobilisation of ferritin-bound iron", XP004136881, Bioorganic & Medicinal Chemistry Letters, vol. 8, pp. 443-446, 1998.

* cited by examiner

*Primary Examiner* — Brian P Mruk
(74) *Attorney, Agent, or Firm* — Thomas G. Krivulka

(57) ABSTRACT

The present invention relates to the use of bis-pyranonyl-methanes in detergents and cleaning agents to improve the washing or cleaning performance in regard to bleachable stains.

7 Claims, No Drawings

WASHING AND CLEANING AGENT

FIELD OF THE INVENTION

The present invention generally relates to the use of specific bis-pyranonylmethanes in detergents and cleaning agents to improve the washing or cleaning performance.

BACKGROUND OF THE INVENTION

Whereas the formulation of powdered, bleach-containing detergent and cleaning agents no longer presents any problems today, the formulation of stable liquid, bleach-containing detergents and cleaning agents continues to represent a problem. Because of the customary absence of the bleaching agent in liquid detergents and cleaning agents, stains that are normally removed particularly because of the present bleaching agents are accordingly often removed only in an inadequate manner. A similar problem also exists for bleach-free color detergents, in which the bleaching agent is omitted in order to protect the dyes in the textile and to prevent them from being bleached. In the absence of the bleaching agent, a further complication is that, instead of the removal of so-called bleachable stains that are normally removed at least partially by the peroxygen-based bleaching agent, on the contrary, the stain is often even intensified or made more difficult to remove as a result of the washing process; this might be attributed not least to initiated chemical reactions, which, for example, can consist of the polymerization of certain dyes present in the stains.

Such problems occur in particular with stains containing polymerizable substances. The polymerizable substances are principally polyphenolic dyes, preferably flavonoids, in particular from the class of anthocyanidins or anthocyans. The stains can have been caused in particular by food products or beverages that contain corresponding dyes. The stains can be in particular spots caused by fruits or vegetables or red wine spots as well which contain polyphenolic dyes in particular, principally those from the class of anthocyanidins or anthocyans.

For example, the use of gallic acid esters such as propyl gallate in detergents and washing agents to improve the removal of stains containing polymerizable substances is known from the international patent application WO 2011/023716 A1.

The use of 4-pyridinones substituted at the N atom optionally with organic groups, such as methyl, ethyl, propyl, phenyl, naphthyl, or carboxyethyl groups, for removing stains from textiles is known from the international patent application WO 2007/042140 A2.

The dimer of kojic acid and its chelation property for iron was described by R. C. Fox and P. D. Taylor in Bioorganic & Medicinal Chem. Lett. 8 (1998), 443-446.

It has now been found surprisingly that the washing or cleaning performance of the detergent or cleaning agent can be considerably improved particularly in regard to bleachable stains by using the kojic acid dimer and analogous bis-pyranonylmethanes.

Furthermore, other desirable features and characteristics of the present invention will become apparent from the subsequent detailed description of the invention and the appended claims, taken in conjunction with this background of the invention.

BRIEF SUMMARY OF THE INVENTION

Use of compounds of the general formula (I), (I)

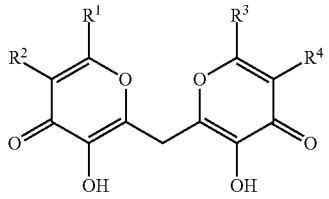

where $R^1$, $R^2$, $R^3$, and $R^4$ independently of one another stand for hydrogen, an alkyl group having 1 to 20 C atoms, $(CH_2)_nOR^5$, $(CH_2)_nCOOR^6$, $(CH_2)_nCONR^7R^8$, or $SO_3H$, $R^5$, $R^6$, $R^7$, and $R^8$ independently of one another stand for hydrogen or an alkyl group having 1 to 20 C atoms, and n stands for a number from 0 to 6, whereby the chains of the alkyl groups can also be interrupted optionally by heteroatoms such as O, N, or S, and/or the alkyl groups optionally can also hydroxy- and/or amino-substituted, in detergents or cleaning agents to improve the washing or cleaning performance in regard to bleachable stains.

A detergent or cleaning agent, containing a compound of the general formula (I), (I)

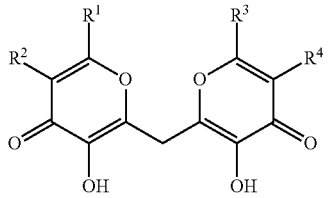

where $R^1$, $R^2$, $R^3$, and $R^4$ independently of one another stand for hydrogen, an alkyl group having 1 to 20 C atoms, $(CH_2)_nOR^5$, $(CH_2)_nCOOR^6$, $(CH_2)_nCONR^7R^8$, or $SO_3H$, $R^5$, $R^6$, $R^7$, and $R^8$ independently of one another stand for hydrogen or an alkyl group having 1 to 20 C atoms, and n stands for a number from 0 to 6, whereby the chains of the alkyl groups can also be interrupted optionally by heteroatoms such as O, N, or S, and/or the alkyl groups optionally can also hydroxy- and/or amino-substituted.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A first subject matter of the present invention is the use of compounds of the general formula (I), (I)

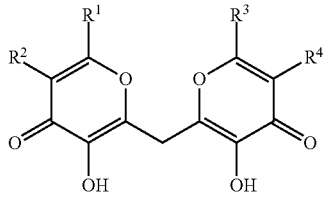

where $R^1$, $R^2$, $R^3$, and $R^4$ independently of one another stand for hydrogen, an alkyl group having 1 to 20 C atoms, $(CH_2)_nOR^5$, $(CH_2)_nCOOR^6$, $(CH_2)_nCONR^7R^8$, or $SO_3H$, $R^5$, $R^6$, $R^7$, and $R^8$ independently of one another stand for hydrogen or an alkyl group having 1 to 20 C atoms, and n stands for a number from 0 to 6, whereby the chains of the alkyl groups can also be interrupted optionally by heteroatoms such as O, N, or S, and/or the alkyl groups optionally can also hydroxy- and/or amino-substituted, in detergents or cleaning agents to improve the washing or cleaning performance in regard to bleachable stains.

The bleachable stains usually contain polymerizable substances, particularly polymerizable dyes, whereby the polymerizable dyes are preferably polyphenolic dyes, particularly flavonoids, principally anthocyanidins or anthocyans or oligomers of said compounds. Apart from the removal of stains in the colors green, yellow, red, or blue, the removal of stains of intermediate colors, in particular violet, mauve, brown, purple, or pink, is also relevant, as well as stains that have a green, yellow, red, violet, mauve, brown, purple, pink, or blue hue, without being themselves entirely made up of that color. The aforesaid colors can also be in each case in particular light or dark. These are preferably stains, in particular spots of grass, fruits, or vegetables, particularly also stains resulting from food products such as spices, sauces, chutneys, curries, purees, and jams, or beverages such as, for example, coffee, tea, wine, and juices that contain corresponding green, yellow, red, violet, mauve, brown, purple, pink, and/or blue dyes.

The stains to be removed according to the invention can be caused in particular by cherry, morello cherry, grape, apple, pomegranate, chokeberry, plum, sea buckthorn, açai, kiwi, mango, grass, or berries, principally by red or black currants, elderberries, blackberries, raspberries, blueberries, lingonberries, cranberries, strawberries, or bilberries, by coffee, tea, red cabbage, blood orange, eggplant, tomato, carrot, red beets, spinach, paprika, red or blue potatoes, or red onions.

Compounds of the general formula (I) can be prepared in analogy to the method described in Bioorganic & Medicinal Chem. Lett. 8 (1998), 443-446. $R^1$ and $R^3$ and/or $R^2$ and $R^4$ in the compounds of the general formula (I) are preferably the same. $R^1$ and/or $R^3$ are preferably hydrogen. $R^2$ and/or $R^4$ are preferably $CH_2OH$ or $CH_2CH_2COOH$.

The compound of the general formula (I) is used according to the invention in detergents or cleaning agents preferably by being used in an amount of 0.001% by weight to 20% by weight, particularly in an amount of 0.01% by weight to 10% by weight, whereby here and hereinafter the quantities given in "% by weight" refer in each case to the weight of the total detergent or cleaning agent. A further subject matter of the invention therefore is a detergent or cleaning agent containing a compound of the general formula (I) in an amount of preferably 0.001% by weight to 20% by weight, particularly 0.01% by weight to 10% by weight, whereby the preferred embodiments described previously and hereinafter also apply to this subject matter of the invention. Such an agent is used in customary washing or cleaning methods to be carried out by machine or manually, in which soiled laundry or a soiled hard surface is exposed to an aqueous bath containing the agent with the aim of removing the soil from the textile or hard surface.

The detergent or cleaning agent can be present in any delivery form established according to the prior art and/or any expedient form. These include, for example, solid, powdered, liquid, gel-like, or pasty delivery forms, optionally consisting of multiple phases; these include further, for example: extrudates, granules, tablets, or pouches, both in large containers and packaged in batches.

The use according to the invention occurs in a preferred embodiment in a detergent or cleaning agent that contains no oxidative bleaching agents. This is to be understood to mean that the agent contains no oxidative bleaching agents in the narrower sense, which include hypochlorites, hydrogen peroxide, or substances yielding hydrogen peroxide, and peroxy acids; preferably it also has no bleach activators and/or bleach catalysts.

The detergent in an especially preferred embodiment is a liquid textile detergent.

The detergent in another especially preferred embodiment is a powdered or liquid color detergent, therefore a textile detergent for colored textiles.

The detergents or cleaning agents can contain, apart from the active substance essential to the invention, other typical components of detergents or cleaning agents, particularly textile detergents, particularly selected from the group of builders and surfactants, as well as preferably polymers, enzymes, disintegration aids, scents, and perfume carriers.

Builders include in particular zeolites, silicates, carbonates, organic cobuilders, and, provided there are no ecological prejudices against their use, phosphates as well.

The finely crystalline synthetic zeolite containing bound water is preferably zeolite A and/or zeolite P. Zeolite MAP® (commercial product of the company Crosfield), for example, is appropriate as zeolite P. Zeolite X and mixtures of zeolite A, X, and/or P are also suitable, however. Also commercially available and usable in the context of the present invention is, for example, a co-crystallizate of zeolite X and zeolite A (approximately 80% by weight of zeolite X) that can be described by the formula $$n\mathrm{Na_2O}.(1-n)\mathrm{K_2O}.\mathrm{Al_2O_3}.(2-2.5)\mathrm{SiO_2}.(3.5-5.5)\mathrm{H_2O}.$$

The zeolite in this regard can be used both as the builder in a granular compound and also as a type of "powdering" of a granular mixture, preferably a mixture to be compressed, whereby typically both approaches to incorporating the zeolite into the premix are utilized. Zeolites can have an average particle size of less than 10 μm (volume distribution; measurement method: Coulter counter) and preferably contain 18% by weight to 22% by weight, particularly 20% by weight to 22% by weight of bound water.

Crystalline sheet silicates of the general formula $NaMSi_xO_{2x+1}.yH_2O$ can also be used, where M represents sodium or hydrogen, and x is a number from 1.9 to 22, preferably from 1.9 to 4, especially preferred values for x being 2, 3, or 4, and y stands for a number from 0 to 33, preferably from 0 to 20. The crystalline sheet silicates of the formula $NaMSi_xO_{2x+1}.yH_2O$ are marketed, for example, by the company Clariant GmbH (Germany) under the trade name Na-SKS. Examples of these silicates are Na-SKS-1 ($Na_2Si_{22}O_{45}.xH_2O$, kenyaite), Na-SKS-2

($Na_2Si_{14}O_{29}.xH_2O$, magadiite), Na-SKS-3 ($Na_2Si_8O_{17}.xH_2O$), or Na-SKS-4 ($Na_2Si_4O_9.xH_2O$, makatite).

Crystalline phyllosilicates of the formula $NaMSi_xO_{2x+1}.yH_2O$, in which x stands for 2, are preferred. Both β- and δ-sodium disilicates $Na_2Si_2O_5.yH_2O$ and furthermore principally Na-SKS-5 ($\alpha$-$Na_2Si_2O_5$), Na-SKS-7 ($\beta$-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$), and Na-SKS-13 ($NaHSi_2O_5$), but in particular Na-SKS-6 ($\delta$-$Na_2Si_2O_5$), are particularly preferred. Detergents or cleaning agents preferably contain a weight proportion of the crystalline sheet silicates of the formula $NaMSi_xO_{2x+1}.yH_2O$ of 0.1% by weight to 20% by weight, preferably of 0.2% by weight to 15% by weight, and particularly of 0.4% by weight to 10% by weight.

Amorphous sodium silicates may also be used which have a $Na_2O:SiO_2$ modulus of 1:2 to 1:3.3, preferably of 1:2 to 1:2.8, and especially of 1:2 to 1:2.6, which preferably have a delayed dissolution and secondary detergent properties. The dissolution delay relative to conventional amorphous sodium silicates can have been produced in various ways, for example, by surface treatment, compounding, compaction/densification, or by overdrying. The term "amorphous" is understood to mean that in X-ray diffraction experiments, the silicates do not give the sharp X-ray reflections typical of crystalline substances, but produce at most one or more maxima of scattered X-ray radiation, which have a width of several degree units of the diffraction angle.

Alternatively or in combination with the aforementioned amorphous sodium silicates, X-ray amorphous silicates can be used whose silicate particles yield blurred or even sharp diffraction maxima in electron beam diffraction experiments. This is to be interpreted to mean that the products have microcrystalline regions with a size from 10 to a few hundred nanometers, preference being given to values up to a maximum of 50 nm and in particular up to a maximum of 20 nm. X-ray amorphous silicates of this type also have a dissolution delay as compared with conventional water glasses. Densified/compacted amorphous silicates, compounded amorphous silicates, and overdried X-ray amorphous silicates are particularly preferred.

This (these) silicate(s), preferably alkali silicates, particularly preferably crystalline or amorphous alkali disilicates, if present, are contained in detergents or cleaning agents in amounts of 3% by weight to 60% by weight, preferably of 8% by weight to 50% by weight, and particularly of 20% by weight to 40% by weight.

Use of the commonly known phosphates as builder substances is also possible, provided such use is not to be avoided for ecological reasons. Of the many commercially available phosphates, the alkali metal phosphates have the greatest importance in the detergent and cleaning agent industry with particular preference for pentasodium or pentapotassium triphosphate (sodium or potassium tripolyphosphate).

Alkali metal phosphates is the collective term for the alkali metal (particularly sodium and potassium) salts of the various phosphoric acids, it being possible to distinguish metaphosphoric acids $(HPO_3)_n$ and orthophosphoric acid $H_3PO_4$, in addition to higher-molecular-weight representatives. The phosphates combine several advantages: they act as alkali carriers, prevent lime deposits on machine parts or lime incrustations in fabrics and, moreover, contribute to the cleaning performance. Technically especially important phosphates are pentasodium triphosphate, $Na_5P_3O_{10}$ (sodium tripolyphosphate), and the corresponding potassium salt, pentapotassium triphosphate, $K_5O_3O_{10}$ (potassium tripolyphosphate). Furthermore, sodium potassium tripolyphosphates are used with preference. If phosphates are used in detergents or cleaning agents, preferred agents then contain this (these) phosphate(s), preferably alkali metal phosphate(s), particularly preferably pentasodium or pentapotassium triphosphate (sodium or potassium tripolyphosphate), in amounts of 5% by weight to 80% by weight, preferably of 15% by weight to 75% by weight, and particularly of 20% by weight to 70% by weight.

Furthermore, alkali carriers are usable. Alkali carriers are considered to be, for example, alkali metal hydroxides, alkali metal carbonates, alkali metal hydrogen carbonates, alkali metal sesquicarbonates, the aforesaid alkali silicates, alkali metasilicates, and mixtures of the aforesaid substances, whereby the alkali carbonates, in particular sodium carbonate, sodium hydrogen carbonate, or sodium sesquicarbonate, are preferably used. A builder system containing a mixture of tripolyphosphate and sodium carbonate can be particularly preferred. Because of their low chemical compatibility with the other ingredients of detergents or cleaning agents as compared with other builder substances, the alkali metal hydroxides are typically used only in small amounts, preferably in amounts below 10% by weight, preferably below 6% by weight, particularly preferably below 4% by weight, and particularly below 2% by weight. Agents containing, based on their total weight, less than 0.5% by weight and particularly no alkali metal hydroxides are particularly preferred. It is preferred to use carbonate(s) and/or hydrogen carbonate(s), preferably alkali carbonate(s), particularly preferably sodium carbonate, in amounts of 2% by weight to 50% by weight, preferably 5% by weight to 40% by weight, and particularly 7.5% by weight to 30% by weight.

Polycarboxylates/polycarboxylic acids, polymeric polycarboxylates, aspartic acid, polyacetals, dextrins, as well as phosphonates can be named in particular as organic builders. Polycarboxylic acids usable, for example, in the form of the free acid and/or sodium salts thereof can be employed, "polycarboxylic acids" being understood as carboxylic acids that carry more than one acid function. These are, for example, citric acid, adipic acid, succinic acid, glutaric acid, malic acid, tartaric acid, maleic acid, fumaric acid, sugar acids, aminocarboxylic acids, nitrilotriacetic acid (NTA), provided this type of use is not objectionable for ecological reasons, and mixtures thereof. Apart from their builder effect, the free acids typically also possess the property of an acidifying component and thus also serve to establish a lower and milder pH value for detergents or cleaning agents. Citric acid, succinic acid, glutaric acid, adipic acid, gluconic acid, and any mixtures thereof can be named in particular. Further, polymeric polycarboxylates are suitable as builders; these are, for example, the alkali metal salts of polyacrylic acid or polymethacrylic acid, for example, those with a relative molecular mass from 500 g/mol to 70,000 g/mol. Suitable in particular are polyacrylates, preferably having a molecular mass of 2000 g/mol to 20,000 g/mol. Because of their superior solubility, the short-chain polyacrylates, which have molar masses of 2000 g/mol to 10,000 g/mol, and particularly preferably of 3000 g/mol to 5000 g/mol, can be preferred from this group in turn. Suitable furthermore are copolymeric polycarboxylates, particularly those of acrylic acid with methacrylic acid and acrylic acid or methacrylic acid with maleic acid. Copolymers of acrylic acid with maleic acid, which contain 50% by weight to 90% by weight of acrylic acid and 50% by weight to 10% by weight of maleic acid, have proven especially suitable. Their relative molecular mass, based on free acids, is in general 2000 g/mol to 70,000 g/mol, preferably 20,000 g/mol to 50,000 g/mol, and particularly 30,000 g/mol to 40,000 g/mol. To improve the water solubility, the polymers can also contain allylsulfonic acids, such as, for example, allyloxybenzenesulfonic acid and methallylsulfonic acid, as monomer. The (co)polymeric polycarboxylates can be used as a solid or in aqueous solution. The content of (co)polymeric polycarboxylates in detergents or cleaning agents is preferably 0.5% by weight to 20% by weight and particularly 3% by weight to 10% by weight.

Particularly preferred are also biodegradable polymers of more than two different monomer units, for example, those that contain as monomers salts of acrylic acid and maleic acid, as well as vinyl alcohol or vinyl alcohol derivatives, or as monomers salts of acrylic acid and 2-alkyl allylsulfonic acid and sugar derivatives. Other preferred copolymers are those that have as monomers acrolein and acrylic acid/acrylic acid salts or acrolein and vinyl acetate. Similarly, polymeric aminodicarboxylic acids, salts thereof, or precursor substances thereof can be mentioned as other preferred builder substances. Particularly preferred are polyaspartic acids and/or salts thereof.

Another class of substances with builder properties are phosphonates. These are the salts of particularly hydroxyalkane- or aminoalkanephosphonic acids. Among the hydroxyalkanephosphonic acids, 1-hydroxyethane-1,1-diphosphonic acid (HEDP) is of particular importance. It is used particularly as the sodium salt, whereby the disodium salt reacts neutrally and the tetrasodium salt alkalinically. Suitable aminoalkanephosphonic acids are, in particular, ethylenediaminetetramethylenephosphonic acid (EDTMP), diethylenetriaminepentamethylenephosphonic acid (DTPMP), and their higher homologs. They are used in particular in the form of the neutrally reacting sodium salts, thus, for example, as the hexasodium salt of EDTMP or as the hepta- and octasodium salt of DTPMP. Mixtures of the aforesaid phosphonates can also be used as organic builders. Aminoalkanephosphonates in particular, moreover, possess a pronounced heavy metal-binding capacity.

Other suitable builder substances are polyacetals, which can be obtained by reacting dialdehydes with polyol carboxylic acids, which have 5 to 7 C atoms and at least 3 hydroxyl groups. Preferred polyacetals are obtained from dialdehydes, such as glyoxal, glutaraldehyde, terephthalaldehyde, and mixtures thereof and from polyol carboxylic acids, such as gluconic acid and/or glucoheptonic acid.

Other suitable organic builder substances are dextrins, for example, oligomers or polymers of carbohydrates, which can be obtained by partial hydrolysis of starches. The hydrolysis can be carried out by means of conventional, for example, acid- or enzyme-catalyzed processes. These are preferably hydrolysis products with average molar masses in the range of 400 g/mol to 500,000 g/mol. In this regard, a polysaccharide with a dextrose equivalent (DE) in the range of 0.5 to 40, particularly 2 to 30, is preferred, whereby DE is a customary measure for the reducing action of a polysaccharide in comparison with dextrose, which has a DE of 100. Both maltodextrins with a DE between 3 and 20 and dry glucose syrups with a DE between 20 and 37, as well as so-called yellow dextrins and white dextrins with higher molar masses in the range of 2000 g/mol to 30,000 g/mol can be used. The oxidized derivatives of such dextrins are their reaction products with oxidizing agents, which are capable of oxidizing at least one alcohol function of the saccharide ring to the carboxylic acid function.

Oxydisuccinates and other derivatives of disuccinates, preferably ethylenediamine disuccinate, are also other suitable cobuilders. In this case, ethylenediamine-N,N'-disuccinate (EDDS) is used preferably in the form of its sodium or magnesium salts. Furthermore, glycerol disuccinates and glycerol trisuccinates are also preferred in this regard. If desired, suitable use amounts particularly in zeolite-containing and/or silicate-containing formulations are 3% by weight to 15% by weight.

Other usable organic cobuilders are, for example, acetylated hydroxycarboxylic acids or salts thereof, which can optionally also be present in lactone form and which contain at least 4 carbon atoms and at least one hydroxy group, as well as a maximum of two acid groups.

Moreover, all compounds capable of forming complexes with alkaline earth ions can be used as builders.

Detergents and cleaning agents can contain nonionic, anionic, cationic, and/or amphoteric surfactants.

All nonionic surfactants known to the skilled artisan can be used as nonionic surfactants. With particular preference, detergents or cleaning agents contain nonionic surfactants from the group of alkoxylated alcohols. Used as nonionic surfactants are preferably alkoxylated, advantageously ethoxylated, particularly primary alcohols having preferably 8 to 18 C atoms and on average 1 to 12 mol of ethylene oxide (EO) per mole of alcohol, in which the alcohol group can be linear or preferably methyl-branched in the 2-position or can contain linear and methyl-branched groups in a mixture, as they are usually present in oxo alcohol groups. Alcohol ethoxylates with linear groups of alcohols of native origin having 12 to 18 C atoms, e.g., from coconut, palm, tallow fatty, or oleyl alcohol, and on average 2 to 8 mol of EO per mole of alcohol are preferred in particular, however. Preferred ethoxylated alcohols include, for example, $C_{12-14}$ alcohols with 3 EO or 4 EO, $C_{9-11}$ alcohols with 7 EO, $C_{13-15}$ alcohols with 3 EO, 5 EO, 7 EO, or 8 EO, $C_{12-18}$ alcohols with 3 EO, 5 EO, or 7 EO, and mixtures thereof, such as mixtures of $C_{12-14}$ alcohol with 3 EO and $C_{12-18}$ alcohol with 5 EO. The indicated degrees of ethoxylation represent statistical averages, which for a specific product can correspond to an integer or a fractional number. Preferred alcohol ethoxylates have a narrow homolog distribution (narrow range ethoxylates, NRE).

Alternatively or in addition to these nonionic surfactants, fatty alcohols with more than 12 EO can also be used. Examples of these are tallow fatty alcohol with 14 EO, 25 EO, 30 EO, or 40 EO. In addition, also usable as further nonionic surfactants are alkyl glycosides having the general formula $RO(G)_x$, in which R corresponds to a primary straight-chain or methyl-branched aliphatic group, especially methyl-branched in the 2-position, having 8 to 22, preferably 12 to 18 C atoms, and G is the symbol for a glycose unit having 5 or 6 C atoms, preferably glucose. The degree of oligomerization x, which indicates the distribution of monoglycosides and oligoglycosides, is any number between 1 and 10; x is preferably 1.2 to 1.4.

A further class of preferably used nonionic surfactants, which are used either as the only nonionic surfactant or in combination with other nonionic surfactants, is alkoxylated, preferably ethoxylated, or ethoxylated and propoxylated fatty acid alkyl esters, preferably having 1 to 4 carbon atoms in the alkyl chain.

Nonionic surfactants of the amine oxide type, such as N-coco alkyl-N,N-dimethylamine oxide and N-tallow alkyl-N,N-dihydroxyethylamine oxide, and fatty acid alkanolamides can also be used. The amount of these nonionic surfactants is preferably no more than that of the ethoxylated fatty alcohols, particularly no more than half thereof.

Other suitable surfactants are polyhydroxy fatty acid amides of the formula

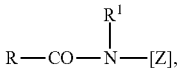

where R stands for an aliphatic acyl group having 6 to 22 carbon atoms, $R^1$ for hydrogen, an alkyl or hydroxyalkyl group having 1 to 4 carbon atoms, and [Z] for a linear or branched polyhydroxyalkyl group having 3 to 10 carbon atoms and 3 to 10 hydroxyl groups. Polyhydroxy fatty acid amides are known substances, which typically can be obtained by reductive amination of a reducing sugar with ammonia, an alkylamine, or an alkanolamine and subsequent acylation with a fatty acid, a fatty acid alkyl ester, or a fatty acid chloride. The group of polyhydroxy fatty acid amides also includes compounds of the formula

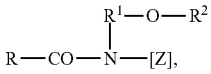

where R stands for a linear or branched alkyl or alkenyl group having 7 to 12 carbon atoms, $R^1$ for a linear, branched, or cyclic alkyl group or an aryl group having 2 to 8 carbon atoms, and $R^2$ for a linear, branched, or cyclic alkyl group or an aryl group or an oxyalkyl group having 1 to 8 carbon atoms, whereby $C_{1-4}$ alkyl or phenyl groups are preferred, and [Z] stands for a linear polyhydroxyalkyl group, whose alkyl chain is substituted with at least two hydroxyl groups, or alkoxylated, preferably ethoxylated or propoxylated derivatives of said group. [Z] is obtained preferably by reductive amination of a reduced sugar, for example, glucose, fructose, maltose, lactose, galactose, mannose, or xylose. The N-alkoxy- or N-aryloxy-substituted compounds can be converted into the desired polyhydroxy fatty acid amides by reaction with fatty acid methyl esters in the presence of an alkoxide as the catalyst.

In cleaning agents, nonionic surfactants from the group of alkoxylated alcohols, particularly preferably from the group of mixed alkoxylated alcohols, and in particular from the group of EO/AO/EO nonionic surfactants or PO/AO/PO nonionic surfactants, especially PO/EO/PO nonionic surfactants, are particularly preferred. These PO/EO/PO nonionic surfactants are notable for good foam control.

Those of the sulfonate and sulfate type, for example, are employed as anionic surfactants. Preferably, $C_{9-13}$ alkylbenzene sulfonates, olefin sulfonates, i.e., mixtures of alkene and hydroxyalkane sulfonates, and disulfonates, as are obtained, for example, from $C_{12-18}$ monoolefins with a terminal or internal double bond by sulfonation with gaseous sulfur trioxide and subsequent alkaline or acid hydrolysis of the sulfonation products, may be used as the sulfonate type surfactants. Alkane sulfonates, obtained from $C_{12-18}$ alkanes, for example, by chlorosulfonation or sulfoxidation with subsequent hydrolysis or neutralization, are also suitable. Likewise, esters of α-sulfofatty acids (ester sulfonates), for example, the α-sulfonated methyl esters of hydrogenated coconut, palm kernel, or tallow fatty acids are also suitable.

Other suitable anionic surfactants are sulfonated fatty acid glycerol esters. Fatty acid glycerol esters are understood to be the mono-, di-, and triesters and mixtures thereof, as are obtained during preparation by esterification of a monoglycerol with 1 to 3 mol of fatty acid or by the transesterification of triglycerides with 0.3 to 2 mol of glycerol. Preferred sulfonated fatty acid glycerol esters thereby are the sulfonation products of saturated fatty acids having 6 to 22 carbon atoms, for example, of caproic acid, caprylic acid, capric acid, myristic acid, lauric acid, palmitic acid, stearic acid, or behenic acid.

Preferred as alk(en)yl sulfates are the alkali and especially the sodium salts of the sulfuric acid half-esters of $C_{12}$-$C_{18}$ fatty alcohols, for example, from coconut fatty alcohol, tallow fatty alcohol, lauryl, myristyl, cetyl, or stearyl alcohol, or $C_{10}$-$C_{20}$ oxo alcohols, and the half-esters of secondary alcohols having said chain lengths. Preferred, furthermore, are alk(en)yl sulfates of the stated chain length which contain a synthetic straight-chain alkyl group prepared on a petrochemical basis, which exhibit degradation behavior similar to that of the appropriate compounds based on fatty chemical raw materials. $C_{12}$-$C_{16}$ alkyl sulfates and $C_{12}$-$C_{15}$ alkyl sulfates, as well as $C_{14}$-$C_{15}$ alkyl sulfates, are preferred from the washing technology viewpoint.

Sulfuric acid monoesters of straight-chain or branched $C_{7-21}$ alcohols ethoxylated with 1 to 6 mol of ethylene oxide, such as 2-methyl-branched $C_{9-11}$ alcohols with an average of 3.5 mol of ethylene oxide (EO) or $C_{12-18}$ fatty alcohols with 1 to 4 EO, are also suitable. Due to their high foaming behavior, they are used in cleaning agents only in relatively small amounts, for example, in amounts of 1% by weight to 5% by weight.

Other suitable anionic surfactants are also the salts of alkyl sulfosuccinic acid, which are also called sulfosuccinates or sulfosuccinic acid esters and represent the monoesters and/or diesters of sulfosuccinic acid with alcohols, preferably fatty alcohols and particularly ethoxylated fatty alcohols. Preferred sulfosuccinates contain $C_{8-16}$ fatty alcohol groups or mixtures thereof. Particularly preferred sulfosuccinates contain a fatty alcohol group derived from ethoxylated fatty alcohols, which are in themselves nonionic surfactants. In this case, sulfosuccinates whose fatty alcohol groups derive from ethoxylated fatty alcohols with a narrow homolog distribution are in turn particularly preferred. It is likewise also possible to use alk(en)ylsuccinic acid having preferably 8 to 18 carbon atoms in the alk(en)yl chain or the salts thereof.

Soaps in particular may be suitable as further anionic surfactants. Saturated fatty acid soaps are suitable, such as the salts of lauric acid, myristic acid, palmitic acid, stearic acid, hydrogenated erucic acid, and behenic acid and in particular soap mixtures derived from natural fatty acids, e.g., coconut, palm kernel, or tallow fatty acids.

The anionic surfactants, including the soaps, can be present in the form of their sodium, potassium, or ammonium salts, as well as soluble salts of organic bases, such as mono-, di-, or triethanolamine. The anionic surfactants are preferably present in the form of the sodium or potassium salts thereof, in particular in the form of the sodium salts.

Instead of the aforesaid surfactants or in conjunction with them, cationic and/or amphoteric surfactants can also be used.

For example, cationic compounds of the following formulas can be used as cationic active substances:

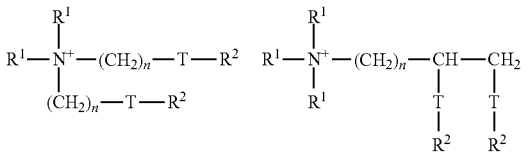

-continued

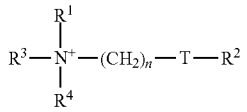

where each group $R^1$ independently of one another is selected from $C_{1-6}$ alkyl, alkenyl, or hydroxyalkyl groups; each group $R^2$ independently of one another is selected from $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO— or —CO—O—, and n is an integer from 0 to 5.

Textile-softening compounds can be used for textile care and to improve textile properties, such as a softer "hand" (feel) and decreased electrostatic charge (increased wearing comfort). The active substances in these formulations are quaternary ammonium compounds having two hydrophobic groups, such as, for example, distearyldimethylammonium chloride, which because of its insufficient biodegradability, however, is increasingly being replaced by quaternary ammonium compounds that contain ester groups in their hydrophobic groups as predetermined breaking points for biodegradation.

"Esterquats" of this kind having improved biodegradability are obtainable, for example, by esterifying mixtures of methyl diethanolamine and/or triethanolamine with fatty acids and then quaternizing the reaction products in known fashion with alkylating agents. Dimethylolethylene urea is additionally suitable as a finish.

Enzymes can be used to increase the performance of detergents or cleaning agents. These include in particular proteases, amylases, lipases, hemicellulases, cellulases, perhydrolases, or oxidoreductases, as well as preferably mixtures thereof. These enzymes are of natural origin in principle; improved variants based on natural molecules are available for use in detergents and cleaning agents and are accordingly preferred for use. Detergents or cleaning agents contain enzymes preferably in total amounts of $1\times10^{-6}$% by weight to 5% by weight, based on active protein. The protein concentration can be determined with the aid of known methods, for example, the BCA method or the biuret method.

Among the proteases, those of the subtilisin type are preferred. Examples of these are the subtilisins BPN' and Carlsberg and further developed forms thereof, protease PB92, subtilisins 147 and 309, the alkaline protease from *Bacillus lentus*, subtilisin DY, and the enzymes thermitase, proteinase K, and the proteases TW3 and TW7, to be classified as subtilases but no longer as subtilisins in the strict sense.

Examples of usable amylases are the α-amylases from *Bacillus licheniformis*, from *B. amyloliquefaciens*, from *B. stearothermophilus*, from *Aspergillus niger* and *A. oryzae*, and the further developments of the aforesaid amylases improved for use in detergents and cleaning agents. To be emphasized, furthermore, for this purpose are the α-amylase from *Bacillus* sp. A 7-7 (DSM 12368) and the cyclodextrin glucanotransferase (CGTase) from *Bacillus* agaradherens (DSM 9948).

Lipases or cutinases are usable because of their triglyceride-cleaving activity. These include, for example, the lipases obtainable originally from *Humicola lanuginosa* (*Thermomyces lanuginosus*) or lipases further developed therefrom, particularly those with the D96L amino acid exchange. Furthermore, for example, cutinases originally isolated from *Fusarium solani pisi* and *Humicola insolens* can be used. Usable furthermore are lipases and/or cutinases, whose starting enzymes were originally isolated from *Pseudomonas mendocina* and *Fusarium solanii*.

Furthermore, enzymes grouped under the term hemicellulases can be used. These include, for example, mannanases, xanthanlyases, pectinlyases (=pectinases), pectinesterases, pectate lyases, xyloglucanases (=xylanases), pullulanases, and β-glucanases.

Oxidoreductases, for example, oxidases, oxygenases, catalases, peroxidases, such as halo-, chloro-, bromoperoxidases or lignin, glucose, or manganese peroxidases, dioxygenases, or laccases (phenoloxidases, polyphenoloxidases), can be used if desired to increase the bleaching effect. Advantageously, preferably organic, particularly preferably aromatic compounds that interact with the enzymes are additionally added in order to enhance the activity of the relevant oxidoreductases (enhancers) or, if there is a large difference in redox potential between the oxidizing enzymes and the stains, to ensure electron flow (mediators).

The enzymes can be used in any form established according to the prior art. These include, for example, the solid preparations obtained by granulation, extrusion, or lyophilization or, in particular in the case of liquid agents or gel-like agents, solutions of the enzymes, advantageously as concentrated as possible, low in water, and/or combined with stabilizers. Alternatively, the enzymes may be encapsulated both for solid and liquid delivery forms, for example, by spray-drying or extrusion of the enzyme solution together with a preferably natural polymer or in the form of capsules, for example, those in which the enzymes are enclosed as in a solidified gel, or in those of the core-shell type, in which an enzyme-containing core is coated with a water-, air-, and/or chemical-impermeable protective layer. In addition, further active substances, for example, stabilizers, emulsifiers, pigments, bleaches, or dyes, can be applied in superimposed layers. Such capsules are applied by methods known per se, for example, by agitated or roll granulation or in fluidized bed processes. Advantageously, such granules are low-dusting, for example, due to application of polymeric film formers, and storage-stable as a result of said coating. It is possible, furthermore, to formulate two or more enzymes together, so that a single granule has multiple enzyme activities.

One or more enzymes and/or enzyme preparations, preferably protease preparations and/or amylase preparations, are preferably used in amounts of 0.1% by weight to 5% by weight, preferably of 0.2% by weight to 4.5% by weight, and particularly of 0.4% by weight to 4% by weight.

Individual fragrance compounds, e.g., synthetic products of the ester, ether, aldehyde, ketone, alcohol, and hydrocarbon types, can be used as perfume oils or scents. Preferably, however, mixtures of different fragrances are used, which together produce an attractive scent note. Such perfume oils can also contain natural fragrance mixtures, as are obtainable from plant sources, e.g., pine, citrus, jasmine, patchouli, rose, or ylang ylang oil. In order to be perceptible, a fragrance must be volatile, whereby in addition to the nature of the functional groups and the structure of the chemical compound, the molar mass also plays an important role. Therefore, most fragrances possess molar masses of up to approximately 200 g/mol, whereas molar masses of 300 g/mol and above represent something of an exception. Because of the differing volatility of fragrances, the odor of a perfume or scent made up of multiple fragrances changes during volatilization, whereby the odor impressions are subdivided into a "top note," "middle note" or "body," and "end note" ("dry out"). Because the perception of an odor also depends to a large extent on the odor intensity, the top note of a perfume or scent is not made up only of highly volatile compounds, whereas the end note comprises for the most part less volatile, i.e., adherent fragrances. In the composing of perfumes, more volatile fragrances can be bound, for example, to specific fixatives, thereby preventing them from volatilizing too quickly. The subdivision below of fragrances into "more volatile" and "adherent" fragrances therefore makes no statement with regard to the odor impression, and, moreover, as to whether the corresponding fragrance is perceived as a top or middle note. The scents can be processed directly, but it can also be advantageous to apply the scents to carriers that ensure a slower scent release for a lasting scent. Cyclodextrins, for example, have proven successful as such carrier materials, whereby the cyclodextrin-perfume complex can be coated in addition with further aids.

In selecting the coloring agent, care must be taken that the coloring agents can have a high storage stability and insensitivity to light and cannot have too strong an affinity for textile surfaces and here in particular for synthetic fibers. At the same time, it must also be considered that coloring agents can have differing resistances to oxidation. It is generally the case that water-insoluble coloring agents are more resistant to oxidation than water-soluble coloring agents. The concentration of the coloring agent in the detergents or cleaning agents varies depending on solubility and thus also on oxidation sensitivity. In the case of readily water-soluble coloring agents, coloring agent concentrations in the range of a few $10^{-2}$% by weight to $10^{-3}$% by weight are typically selected. In the case of pigment dyes, which are particularly preferred because of their brilliance but are less readily water-soluble, the appropriate concentration of the coloring agent in detergents or cleaning agents, in contrast, is typically a few $10^{-3}$% by weight to $10^{-4}$% by weight. Coloring agents that can be oxidatively destroyed in a washing process, as well as mixtures thereof with suitable blue dyes, so-called bluing agents, are preferred. It has proven advantageous to use coloring agents that are soluble in water or at room temperature in liquid organic substances. Suitable, for example, are anionic coloring agents, for example, anionic nitroso dyes.

In addition to the aforementioned components, the detergents or cleaning agents can contain other ingredients that further improve the application and/or aesthetic properties of said agents. Preferred agents contain one or more substances from the group of electrolytes, pH adjusting agents, fluorescent agents, hydrotopes, foam inhibitors, silicone oils, antiredeposition agents, optical brighteners, graying inhibitors, shrinkage preventers, anti-creasing agents, color transfer inhibitors, antimicrobial active substances, germicides, fungicides, antioxidants, antistatic agents, ironing aids, hydrophobizing and impregnating agents, swelling and anti-slip agents, and UV absorbers.

A large number of very different salts from the group of inorganic salts can be used as electrolytes. Alkali and alkaline earth metals are preferred cations, and halides and sulfates are preferred anions. The use of NaCl or $MgCl_2$ in the detergents and cleaning agents is preferred from the production technology standpoint.

Use of pH adjusting agents may be indicated to bring the pH of the detergents or cleaning agents into the desired range. All known acids or bases can be used here, provided their use is not prohibited for application engineering or ecological reasons, or for reasons of consumer protection. The amount of said adjusting agents typically does not exceed 1% by weight of the total formulation.

Soaps, oils, fats, paraffins, or silicone oils, which optionally can be applied onto carrier materials, may be used as foam inhibitors. Suitable as carrier materials are, for example, inorganic salts such as carbonates or sulfates, cellulose derivatives, or silicates, as well as mixtures of the aforesaid materials. Agents preferred in the context of the present application contain paraffins, preferably unbranched paraffins (n-paraffins), and/or silicones, preferably linear polymeric silicones, which are made according to the $(R_2SiO)_x$ formula and are also referred to as silicone oils. These silicone oils usually represent clear, colorless, neutral, odorless, hydrophobic liquids having a molecular weight between 1000 g/mol and 150,000 g/mol and viscosities between 10 mPa·s and 1,000,000 mPa·s.

Suitable soil repellents are polymers, known from the prior art, of phthalic acid and/or terephthalic acid and derivatives thereof, in particular polymers of ethylene terephthalate and/or polyethylene glycol terephthalate or anionically and/or nonionically modified derivatives thereof. Of these, the sulfonated derivatives of phthalic acid polymers and terephthalic acid polymers are particularly preferred.

Optical brighteners can be added in particular to detergents in order to eliminate graying and yellowing of the treated textiles. These substances are absorbed onto the fibers and cause brightening and a simulated bleaching effect by converting invisible ultraviolet radiation into longer-wave visible light, whereby the ultraviolet light absorbed from sunlight is emitted as a slightly bluish fluorescence and produces pure white with the yellow tone of the grayed or yellowed laundry. Suitable compounds come, for example, from the substance classes of the 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalic acid imides, and benzoxazole, benzisoxazole, and benzimidazole systems, as well as the pyrene derivatives substituted with heterocycles.

Graying inhibitors have the task of keeping the dirt, removed from the fibers, suspended in the bath, and thus preventing the redeposition of the dirt. Suitable for this purpose are water-soluble colloids, mostly organic in nature, for example, the water-soluble salts of polymeric carboxylic acids, size, gelatin, salts of ether sulfonic acids of starch or of cellulose, or salts of acidic sulfuric acid esters of cellulose or starch. Water-soluble polyamides containing acid groups are also suitable for this purpose. Soluble starch preparations can be used, furthermore, for example, degraded starch and aldehyde starches. Polyvinylpyrrolidone can also be used. Cellulose ethers such as carboxymethylcellulose (Na salt), methyl cellulose, hydroxyalkyl cellulose, and mixed ethers such as methylhydroxyethyl cellulose, methylhydroxypropyl cellulose, methylcarboxymethyl cellulose, and mixtures thereof, can also be used as graying inhibitors. Especially suitable are, for example, nonionic cellulose ethers such as methyl cellulose and methylhydroxypropyl cellulose having a proportion of 15 to 30% by weight of methoxy groups and of 1 to 15% by weight of hydroxypropyl groups, based in each case on the nonionic cellulose ether.

Synthetic anti-creasing agents can be used because textile fabrics, especially made of rayon, rayon staple, cotton, and mixtures thereof, can tend to wrinkle because the individual fibers are susceptible to bending, kinking, compression, and crimping transverse to the fiber direction. These include, for example, synthetic products based on fatty acids, fatty acid esters, fatty acid amides, fatty acid alkylol esters, fatty acid alkylolamides, or fatty alcohols, usually reacted with ethylene oxide, or products based on lecithin or modified phosphoric acid esters.

The purpose of hydrophobizing and impregnating methods is to finish textiles with substances that prevent the deposition of dirt or facilitate its washing out. Preferred hydrophobizing and impregnating agents are perfluorinated fatty acids, in the form of their aluminum and zirconium salts as well, organic silicates, silicones, polyacrylic acid esters with perfluorinated alcohol components or with polymerizable compounds coupled to a perfluorinated acyl or sulfonyl group. Antistatic agents can also be present. The dirt-repellent finishing with hydrophobizing and impregnating agents is often categorized as an easy care finish. The penetration of the impregnating agents in the form of solutions or emulsions of the relevant active substances can be facilitated by the addition of wetting agents, which reduce surface tension. Another field of application for hydrophobizing and impregnating agents is the water-repellent finishing of textile products, tents, tarps, leather, etc., in which in contrast to waterproofing the fabric pores are not sealed; the material therefore remains breathable (hydrophobizing). The hydrophobizing agents used for hydrophobizing cover the textiles, leather, paper, wood, etc., with a very thin layer of hydrophobic groups, such as longer alkyl chains or siloxane groups. Suitable hydrophobizing agents are, for example paraffins, waxes, metal soaps, etc., with additions of aluminum salts or zirconium salts, quaternary ammonium compounds with long-chain alkyl groups, urea derivatives, fatty acid-modified melamine resins, chromium-complex salts, silicones, organotin compounds, and glutardialdehyde, as well as perfluorinated compounds. The hydrophobized materials do not feel oily; nevertheless, water droplets bead up on them, as on oiled materials, without wetting them. Thus, for example, silicone-impregnated textiles have a soft hand and are water- and dirt-repellent; spots of ink, wine, fruit juices, and the like are easier to remove.

Antimicrobial active substances can be used in order to counteract microorganisms. Depending on antimicrobial spectrum and mechanism of action, a distinction is made here between bacteriostatics and bactericides, fungistatics and fungicides, etc. Substances from these groups are, for example, benzalkonium chlorides, alkyl aryl sulfonates, halogen phenols, and phenol mercuric acetate, whereby these compounds can also be entirely omitted.

The agents can contain antioxidants in order to prevent undesirable changes to the detergents and/or to the treated textiles as caused by the action of oxygen and other oxidative processes. This class of compounds includes, for example, substituted phenols, hydroquinones, pyrocatechols, and aromatic amines, as well as organic sulfides, polysulfides, dithiocarbamates, phosphites, and phosphonates.

Increased wearing comfort can result from the additional use of antistatic agents. Antistatic agents increase surface conductivity and thereby enable an improved dissipation of the formed charges. External antistatic agents are usually substances with at least one hydrophilic molecular ligand and produce a more or less hygroscopic film on the surfaces. These mostly surface-active antistatic agents can be subdivided into nitrogen-containing (amines, amides, quaternary ammonium compounds), phosphorus-containing (phosphoric acid esters), and sulfur-containing antistatic agents (alkyl sulfonates, alkyl sulfates). Lauryl (or stearyl) dimethyl benzyl ammonium chlorides are likewise suitable as antistatic agents for textiles or as an additive to detergents, a softening effect being achieved in addition.

Silicone derivatives can be used in textile detergents to improve the water absorption capability and rewettability of the treated textiles and to facilitate ironing of the treated textiles. These improve in addition the rinsing behavior of detergents or cleaning agents due to their foam-inhibiting properties. Preferred silicone derivatives are, for example, polydialkyl- or alkylarylsiloxanes in which the alkyl groups comprise one to five carbon atoms and are entirely or partially fluorinated. Preferred silicones are polydimethylsiloxanes which may optionally be derivatized and are then amino-functional or quaternized, or have Si—OH, Si—H, and/or Si—Cl bonds. Other preferred silicones are the polyalkylene oxide-modified polysiloxanes, therefore polysiloxanes that have, for example, polyethylene glycols, as well as polyalkylene oxide-modified dimethylpolysiloxanes.

Lastly, UV absorbers can also be used, which absorb onto the treated textiles and improve the light-fastness of the fibers. Compounds having these desired properties are, for example, compounds acting by radiationless deactivation and derivatives of benzophenone with substituents in the 2- and/or 4-position. Furthermore, also suitable are substituted benzotriazoles, acrylates phenyl-substituted in the 3-position (cinnamic acid derivatives), optionally with cyano groups in the 2-position, salicylates, organic Ni complexes, and natural substances such as umbelliferone and the endogenous urocanic acid.

Protein hydrolysates are other suitable active substances because of their fiber-care-providing effect. Protein hydrolysates are product mixtures obtained by acid-, base-, or enzyme-catalyzed degradation of proteins. Protein hydrolysates of both vegetable and animal origin can be used. Animal protein hydrolysates are, for example, elastin, collagen, keratin, silk, and milk protein hydrolysates, which can also be present in the form of salts. It is preferred to use protein hydrolysates of vegetable origin, for example, soy, almond, rice, pea, potato, and wheat protein hydrolysates. Although the use of protein hydrolysates as such is preferred, amino acid mixtures obtained in other ways, or individual amino acids such as arginine, lysine, histidine, or pyroglutamic acid, can also optionally be used instead of them. It is also possible to employ derivatives of protein hydrolysates, for example, in the form of their fatty acid condensation products.

EXAMPLES

Washing tests were carried out at 40° C. with standardized stains of aqueous extracts of the substances given in Table 1 on cotton with use of a bleaching agent-free liquid detergent V1 (dose of 69 g in 17 L of water of 16° dH) and a mixture M1 of detergent V1 and compound A

A

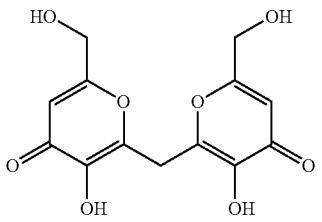

(dose of 69 g of V1 and 1.4 g of A in 17 L water of 16° dH). After the cotton cloths were dried, their brightness was determined by measuring the color difference according to L*a*b* values and the Y values calculated therefrom as a measure of the brightness. Table 1 shows the difference values dY, obtained from the difference Y (after washing)−Y (before washing).

TABLE 1

| Brightness differences | | |
|---|---|---|
| | agent | |
| Stain | M1 | V1 |
| Cherry | 17.2 | 15.2 |
| Red wine | 23.8 | 22.4 |
| Red grape | 28.1 | 24.5 |
| Black currant | 21.6 | 18.9 |
| Bilberry | 18.1 | 11.6 |

The brightness differences during use of the substance essential to the invention were significantly greater than those obtained with the use of the comparison detergent without the substance; this corresponds to a greater whiteness and thus to an improved spot removal.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A detergent or cleaning agent, comprising a compound of the general formula (I), (I)

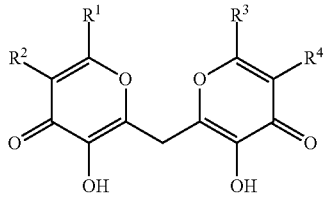

where $R^1$, $R^2$, $R^3$, and $R^4$ independently of one another stand for hydrogen, an alkyl group having 1 to 20 C atoms, $(CH_2)_nOR^5$, $(CH_2)_nCOOR^6$, $(CH_2)_nCONR^7R^8$, or $SO_3H$, wherein $R^5$, $R^6$, $R^7$, and $R^8$ independently of one another stand for hydrogen or an alkyl group having 1 to 20 C atoms, and n stands for a number from 0 to 6, and whereby the chains of the alkyl groups may also be interrupted by heteroatoms such as O, N, or S, and/or the alkyl groups may also be hydroxy- and/or amino-substituted; and wherein the agent further comprises components of textile detergents selected from the group consisting of builders and surfactants.

2. The agent according to claim 1, wherein the compound of general formula (I) comprises 0.001% by weight to 20% by weight of the agent.

3. The agent according to claim 1, wherein it comprises no oxidative bleaching agents selected from the group consisting of hypochlorites, hydrogen peroxide, substances yielding hydrogen peroxide, and peroxy acids.

4. The agent according to claim 1, characterized in that $R^1$ and $R^3$ are the same in the compounds of the general formula (I).

5. The agent according to claim 1, characterized in that $R^2$ and $R^4$ are the same in the compounds of the general formula (I).

6. The agent according to claim 1, characterized in that $R^1$ and/or $R^3$ are hydrogen in the compound according to general formula (I).

7. The agent according to claim 1, characterized in that $R^2$ and/or $R^4$ are $CH_2OH$ or $CH_2CH_2COOH$ in the compound according to general formula (I).

* * * * *